US012402669B2

(12) United States Patent
Castillo Piedra

(10) Patent No.: US 12,402,669 B2
(45) Date of Patent: Sep. 2, 2025

(54) GARMENT STRAP CLIPS AND GARMENTS WITH STRAP CLIPS

(71) Applicant: Gina Isabel Castillo Piedra, Fort Lee, NJ (US)

(72) Inventor: Gina Isabel Castillo Piedra, Fort Lee, NJ (US)

( * ) Notice: Subject to any disclaimer, the term of this patent is extended or adjusted under 35 U.S.C. 154(b) by 0 days.

(21) Appl. No.: 17/993,094

(22) Filed: Nov. 23, 2022

(65) Prior Publication Data

US 2023/0157378 A1 May 25, 2023

Related U.S. Application Data

(60) Provisional application No. 63/282,263, filed on Nov. 23, 2021.

(51) Int. Cl.
*A41C 3/12* (2006.01)

(52) U.S. Cl.
CPC ..... *A41C 3/12* (2013.01)

(58) Field of Classification Search
CPC ..... A44B 11/04; Y10T 24/44752; Y10T 24/44915; Y10T 24/3444; Y10T 24/3453; Y10T 24/44872; A61B 2017/2808; A61B 50/20; A61B 17/30; A61B 46/23; A61B 17/12; A61B 99/00; F16L 3/12
USPC ..... 450/86; 24/543, 563, 339, 346, 557; 606/157; 2/336
See application file for complete search history.

(56) References Cited

U.S. PATENT DOCUMENTS 1,239,849 A * 9/1917 Vandercook ..... A44B 11/04 24/200
1,820,578 A * 8/1931 Mosgrove ..... A44B 11/04 24/198
1,825,016 A * 9/1931 Salisbury ..... A44B 11/04 24/169
2,809,410 A * 10/1957 Reiter ..... A44B 11/04 24/163 R
3,218,686 A * 11/1965 Rubenstein ..... A44B 11/04 24/198
5,159,730 A * 11/1992 Radvin ..... A47G 25/485 24/543
D398,881 S * 9/1998 France-Davis ..... D11/86
5,935,044 A * 8/1999 Brewster ..... A41F 15/02 450/86

(Continued)

OTHER PUBLICATIONS

"Here is a quick tutorial on the RaZor Clips Bra Concealing Clip", Aug. 16, 2019, Exultimate. https://www.facebook.com/LoveExultimate/videos/here-is-a-quick-tutorial-on-the-razor-clips-bra-concealing-clip-it-can-discretel/339741646911347/ (Year: 2019).*

*Primary Examiner* — Jameson D Collier
*Assistant Examiner* — Matthew R Marchewka
(74) *Attorney, Agent, or Firm* — Daniel P. Burke & Associates, PLLC; Daniel P. Burke; Georgia Damoulakis

(57) ABSTRACT

A garment strap clip used with garments having at least two shoulder straps such as a brassiere or tank top. The strap clip has an outer portion defining a closed curve having a right side and left side. A first clip arm is integrally formed with the right side of the outer portion and a second clip arm is integrally formed with the left side of the outer portion. The first clip arm and the second clip arm extend inwardly to a position proximate the center of the strap clip and are selectively positionable in a disengaged configuration or in an engaged configuration.

17 Claims, 10 Drawing Sheets

(56) References Cited

U.S. PATENT DOCUMENTS

| | | | | |
|---|---|---|---|---|
| 5,964,642 | A * | 10/1999 | Fildan | A41F 1/006 450/86 |
| 6,056,625 | A * | 5/2000 | Fildan | A41F 15/002 450/86 |
| 6,368,180 | B1 * | 4/2002 | Dailey | A41C 3/12 450/86 |
| 2009/0126163 | A1 * | 5/2009 | Groner | A41F 15/02 450/86 |
| 2014/0304898 | A1 * | 10/2014 | Bachtold | A44B 11/04 2/336 |
| 2015/0013049 | A1 * | 1/2015 | Sullivan | A41F 19/00 2/336 |
| 2019/0125034 | A1 * | 5/2019 | Fildan | A41F 1/00 |
| 2019/0274369 | A1 * | 9/2019 | Heyhurst | A41C 3/02 |
| 2020/0037676 | A1 * | 2/2020 | Jebb | A41D 1/18 |
| 2020/0268091 | A1 * | 8/2020 | Lacy | A42B 7/00 |

* cited by examiner

GARMENT STRAP CLIPS AND GARMENTS WITH STRAP CLIPS

RELATED APPLICATION DATA

This application claims the benefit of U.S. Provisional Patent Application Ser. No. 63/282,263, filed Nov. 23, 2021, which is hereby incorporated by reference.

Garment strap clips are disclosed which secure otherwise spaced and often generally parallel shoulder straps, such as brassiere shoulder straps, in close proximity to each other so that the shoulder straps are less visible from the rear when a garment having enlarged armholes, such as a sports top or halter top, is worn over the clipped garment. One embodiment of the disclosed strap clip secures the shoulder straps in close proximity from the rear. The position of the straps can also be adjusted by repositioning, e.g. sliding, the disclosed clips up and down to provide different strap configurations. Garments comprising the disclosed strap clips are also disclosed.

BACKGROUND

Conventional brassieres have two breast cups, a generally horizontally extending torso strap, and two shoulder straps extending generally parallel from the top of each breast cup over a wearer's shoulders and vertically down to the horizontally extending torso strap. Brassiere shoulder straps are not typically visible from the rear when worn with a blouse or t-shirt, but can be visible when worn with other garments, such as halter tops, tank tops, and sports bras. Since visible shoulder straps are regarded by some as being unsightly, there is a need for an improved garment strap clip to secure the two shoulder straps and to minimize the risk of inadvertently unclipping during a wearer's normal movement or when the wearer is engaged in more rigorous activity such as jogging, yoga, cross-fit and various other sports.

BRIEF DECRIPTION OF THE DRAWINGS

DESCRIPTION

Figure 7:
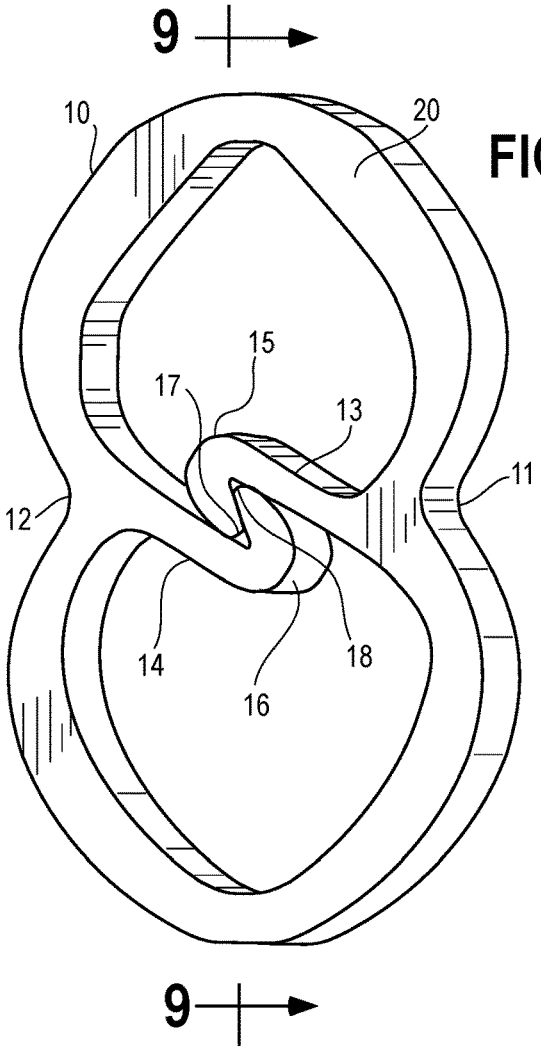
FIG. 7 is a front, perspective view of an embodiment of a garment strap clip in the engaged configuration.
Figure 8:
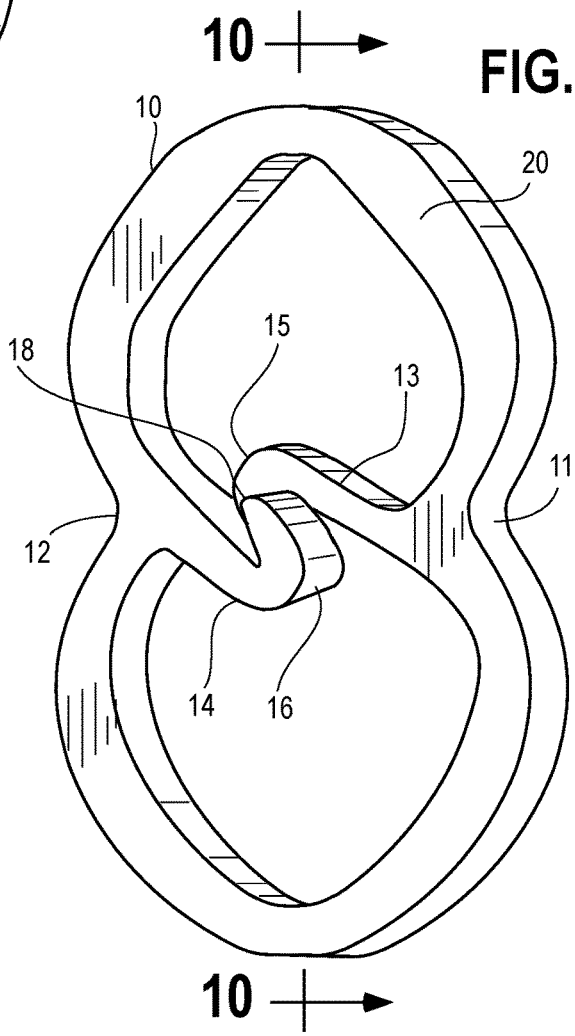
FIG. 8 is a front, perspective view of an embodiment of a garment strap clip in the disengaged configuration.
Figure 16:
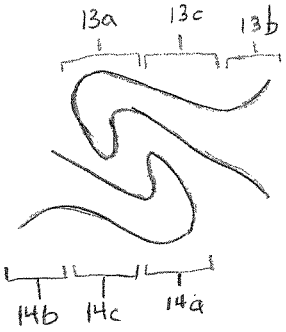
FIG. 16 is a front, exploded view of the first clip arm and second clip arm of the garment strap clip shown in FIG. 7.
Figure 17:
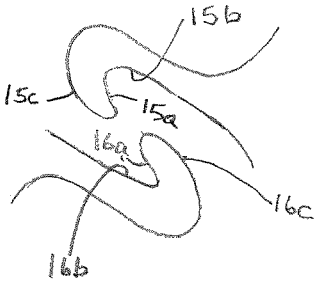
FIG. 17 is a front, exploded view of the first clip arm and the second clip arm of the garment strap clip shown in FIG. 7.

According to one embodiment of the disclosed strap clip, the strap clip 10 is integrally formed and generally oval in shape. With reference to FIGS. 7 and 8, the illustrated strap clip has a generally figure-eight shaped outer portion with a right side 11 and left side 12. A first clip arm (right clip arm) 13, has a distal portion 13*a* and a proximal portion 13*b*. As shown in FIG. 16, an intermediate portion 13*c* is between the distal portion 13*a* and proximal portion 13*b*. The proximal portion 13*b* of the first clip arm 13 is integrally formed with the right side 11 of the outer portion, and extends diagonally inwardly from the right side 11 of the outer portion. The distal portion 13*a* of the first clip arm 13 has a right hook portion 15. The first clip arm 13 extends to about the center of the strap clip 10 with the right hook portion 15 proximate to the center of the strap clip 10. Right hook portion 15 has a terminal end 17. As illustrated in FIG. 17, right hook portion 15 also has an inner surface 15*a*, a surface 15*b* opposite inner surface 15*a* and an outer hook surface 15*c*. The front (or inner) surface 20 is the surface which is closest to the wearer's skin.

A second clip arm 14, has a distal portion 14*a* and a proximal portion 14*b*. An intermediate portion 14*c* is between the distal portion 14*a* and proximal portion 14*b*. The proximal portion 14*b* of the second clip arm 14 is integrally formed with the left side 12 of the outer portion and extends diagonally inwardly from the left side 12 of the outer portion. The distal portion 14*a* of the second clip arm 14 has a left hook portion 16. The intermediate portion 14*c* of the second clip arm 14 is generally parallel to and opposing to the intermediate portion 13*c* of the first clip arm 13. The second clip arm 14 extends to about the center of the strap clip 10 with left hook portion 16 proximate to the center of the strap clip 10. Left hook portion 16 has a terminal end 18. As illustrated in FIG. 17, left hook portion 16 also has an inner surface 16*a*, a surface 16*b* opposite inner surface 16*a* and an outer hook surface 16*c*.

Figure 10:
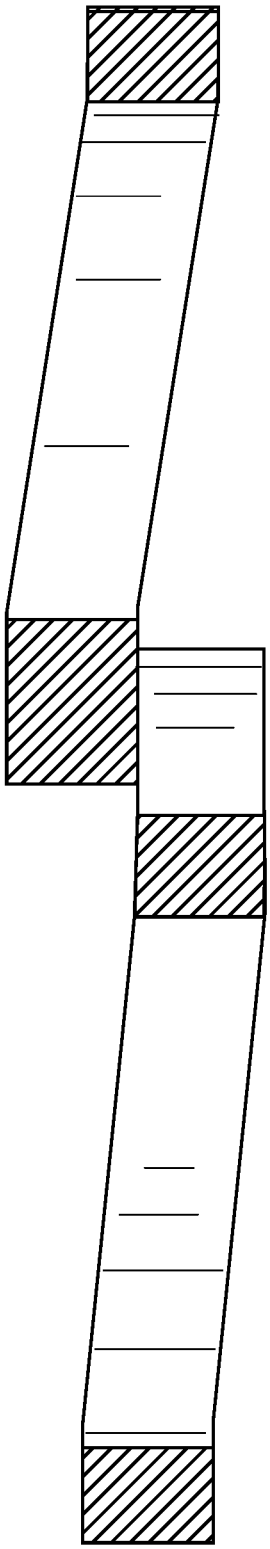
FIG. 10 is a cross sectional view of the disengaged garment strap clip shown in FIG. 8 along lines 10-10.
Figure 14:
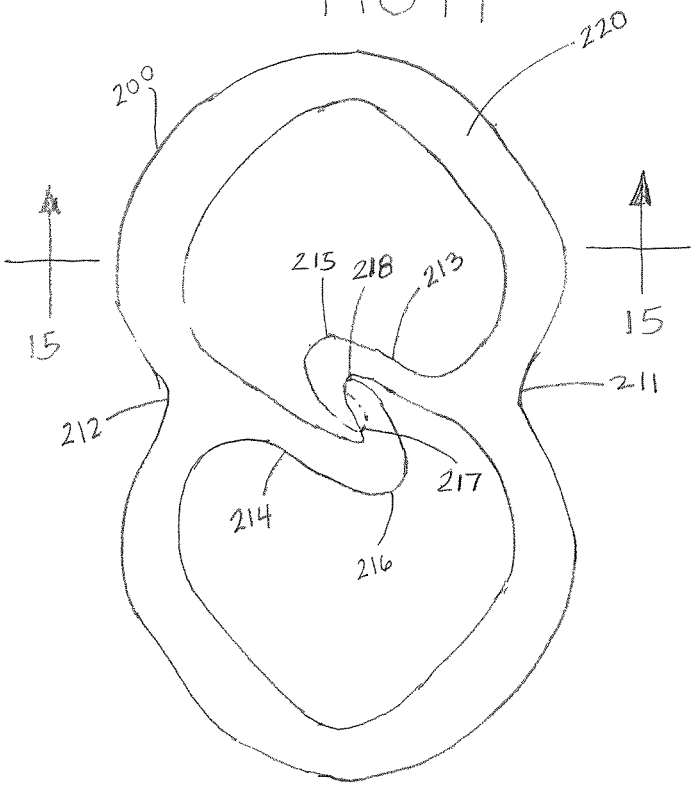
FIG. 14 is a front view of a third embodiment of a garment strap clip.

The material used to form the strap clip 10 is sufficiently pliable to allow the right and left hook portions 15 and 16, of right clip arm 13 and left clip arm 14, respectively, to be selectively positionable in a disengaged configuration and an engaged configuration. In the first embodiment, when the first clip arm 13 and the second clip 14 are in the disengaged configuration, the right hook portion 15 and the left hook portion 16 are in contact in the absence of external forces. As used herein, the term "external force" refers to force applied by something other than the clip itself such as a force applied manually by a person. As shown in FIG. 10, when this illustrated strap clip is in the disengaged configuration, right hook portion 15 is in contact with left hook portion 16. As shown in FIG. 14 which is a front view of the strap clip in the disengaged configuration, right hook portion 215 is positioned behind left hook portion 216. In FIG. 14, a portion of the right hook portion 15 and right terminal end 217 are shown in broken lines to illustrate that left hook portion 216 is positioned in front of the right hook portion 215.

The right hook portion 15 and the left hook portion 16 are selectively separable by a person to allow a shoulder strap to be slid under each clip arm. When the first clip arm 13 and the second clip arm 14 are in an engaged configuration, the inner surface 15*a* of right hook portion 15 and the inner surface 16*a* of left hook portion 16 are in contact and abut each other. In this illustrated embodiment, when in the engaged configuration, outer surface 16*c* of left hook portion 16 is in contact and abuts surface 15*b* of right hook portion 15 and outer surface 15*c* of right hook portion 15 is in contact and abuts surface 16*b* of left hook portion 16.

It will be appreciated that when the first and second clip arms 13 and 14 are moved from the disengaged configuration to the engaged configuration, the right side outer portion 11 and the left side outer portion 12 of the clip 10 are drawn together. The inherent elasticity of the clip and particularly of the outer portions, causes the outer portions to apply an outwardly directed spring force on the arms which helps to maintain the right and left hook portions in the engaged configuration. In other words, in the engaged configuration, the right hook portion 15 and the left hook portion 16 are urged in opposing directions.

The right and left hook portions 15 and 16 are shown in an engaged configuration in FIG. 7 and in a disengaged configuration in FIG. 8. The interaction of the two hook portions 15 and 16 permits a wearer to secure the strap clip 10 in the engaged configuration after the strap clip 10 has been attached to the inner garment shoulder straps. When the hook portions 15 and 16 are in the engaged configuration, undesired movement of the strap clip relative to the garment straps, e.g. sliding of the strap clip up and/or down the garment shoulder straps, during normal movement or during intense physical activity is minimized and preferably prevented. Furthermore, when the hook portions 15 and 16 are in the engaged configuration, the risk of unintentional unclipping of the strap clip 10 from the shoulder straps is minimized.

Figure 2:
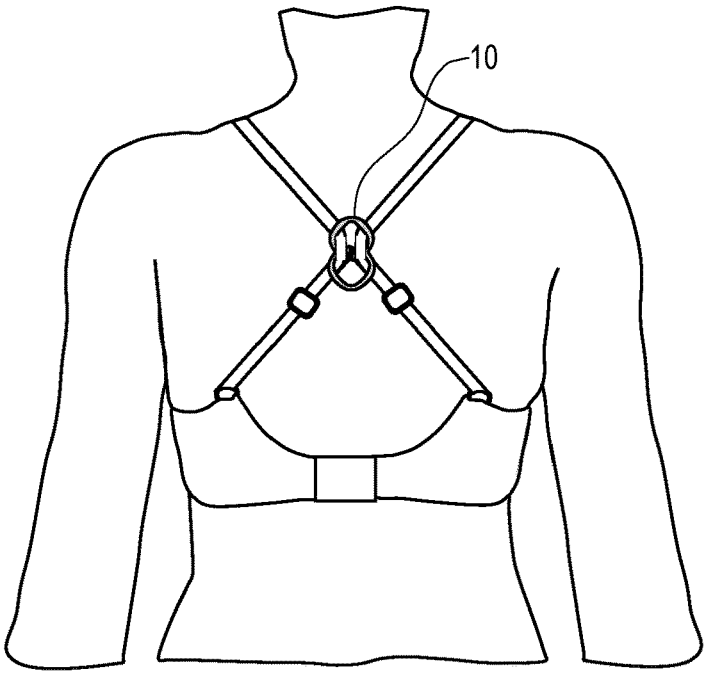
FIG. 2 is a rear view of the upper torso of a woman wearing a conventional brassiere having shoulder straps with an embodiment of the disclosed garment strap clip attached to the shoulder straps.
Figure 13:
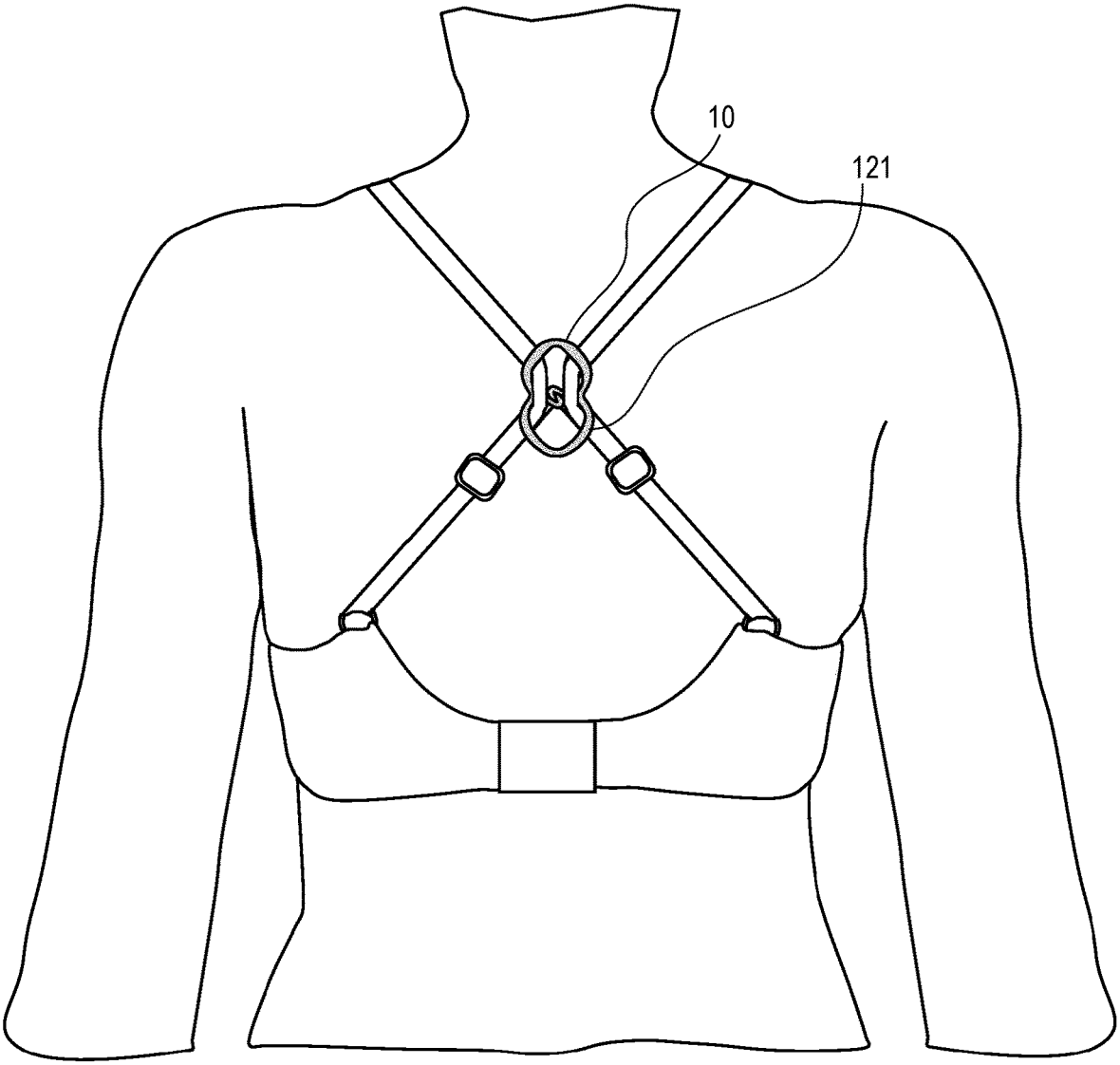
FIG. 13 is a rear view of the upper torso of a woman wearing a brassiere having shoulder straps with the second embodiment of the disclosed garment strap clip attached to the shoulder straps.

In order to connect a strap clip to a garment, if necessary, the wearer first disengages the right and left hook portions 15 and 16 of the strap clip by applying pressure to the right side 11 and left side 12 and moving the first and second clip arms 13 and 14 in opposite directions toward and away from the user, i.e. generally perpendicular to the plane of the clip. The wearer places the right strap under the first clip arm 13 and the left strap under the second clip arm 14. The first and second clip arms 13 and 14 define two openings within the outer portion of the strap clip, namely an upper opening and a lower opening. As shown in FIGS. 2 and 13, the shoulder straps extend into the upper opening from the front of the strap clip, extend around the first and second clip arms, and then extend through the lower opening back out to the front of the strap clip. FIGS. 2 and 13 illustrate the disclosed strap clip attached to brassiere shoulder straps. Once the shoulder straps are in the desired position in the strap clip, the wearer then engages the right and left hook portions 15 and 16 to interlock the respective terminal ends 17 and 18 of the first clip arm 13 and second clip arm 14, as seen in FIG. 7. Engaging the clip arms prevents relative lateral movement of the first clip arm 13 in a direction away from the second clip arm 14 and reduces the risk of the strap clip 10 slipping off the shoulder straps. As noted above, in the engaged configuration, the right hook inner surface 15*a* and the left hook inner surface 16*a* are urged into contact by opposing forces applied by the right side 11 of the outer portion and the left side 12 of the outer portion.

When the strap clip has been positioned in the desired position on the shoulder straps but is still in the disengaged configuration, it will be appreciated that the shoulder straps have been drawn into close proximity. Depending upon the material of the shoulder straps, the material of the strap clip and the position of the strap clip on the garment, there may be sufficient friction and forces to maintain the strap clip in the desired position. The further step of selectively positioning the first and second clip arms in the engaged configuration further secures the strap clip to the shoulder straps and, therefore, the shoulder straps in the desired position.

Figure 15:
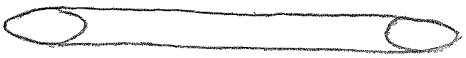
FIG. 15 is a cross sectional view of the garment strap clip shown in FIG. 14 taken along lines 15-15.

In one embodiment, as shown in FIGS. 7 and 8, the strap clip has a flat, smooth front (or inner) surface 20 which is closest to the wearer's skin while the strap clip 10 is in use and a smooth rear (or outer) surface. As described herein, the orientation of the clip is the same orientation as the wearer. In other words, the front (or inner) surface faces the wearer and the rear (or outer) surface faces away (rearwardly) from the wearer. As shown in the cross-sectional view in FIG. 15, according to another embodiment, the strap clip has a smooth rounded front (or inner) surface and rounded rear (or outer) surface.

Figure 11:
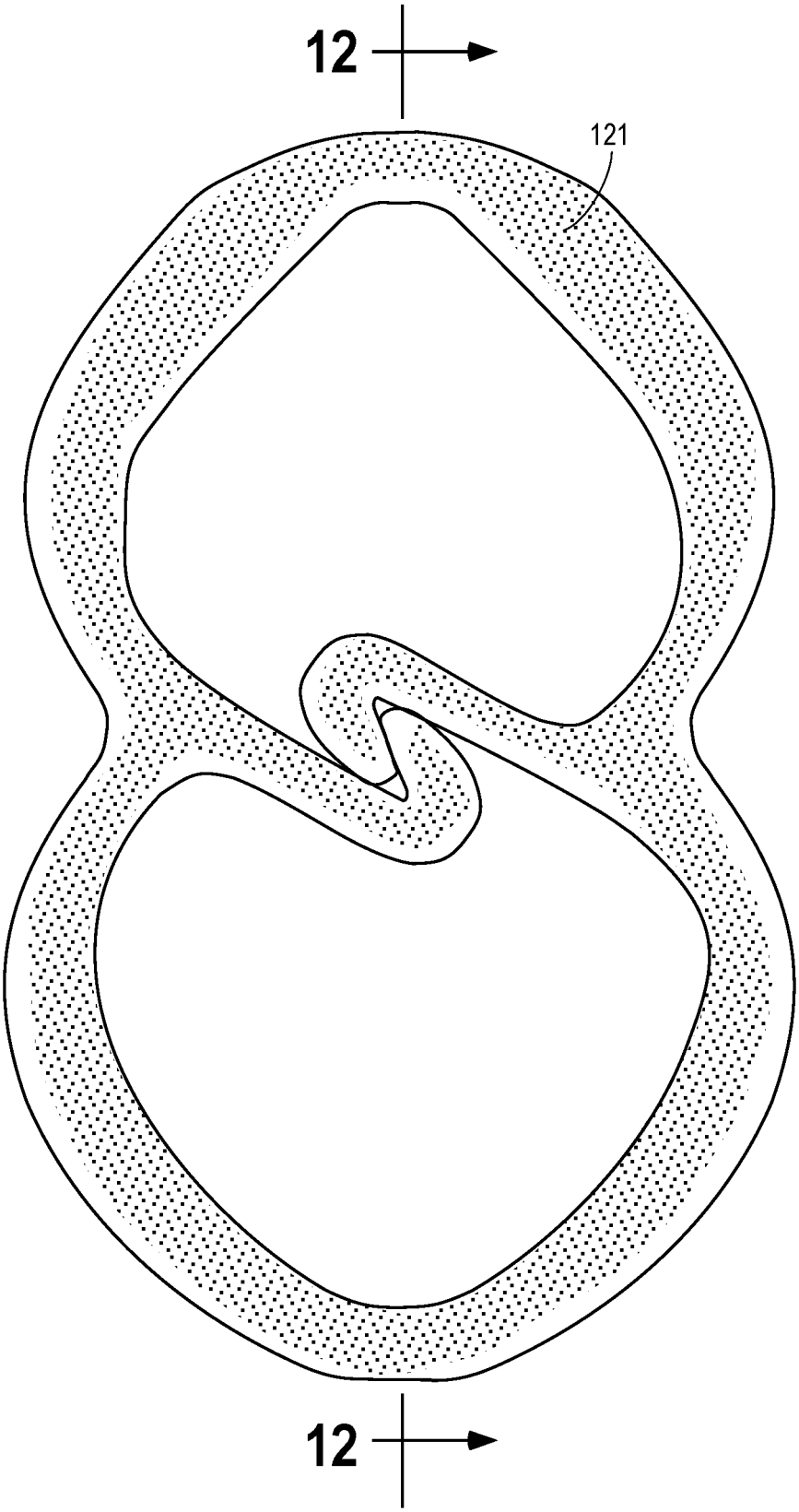
FIG. 11 is a rear view of a second embodiment of a garment strap clip.
Figure 12:
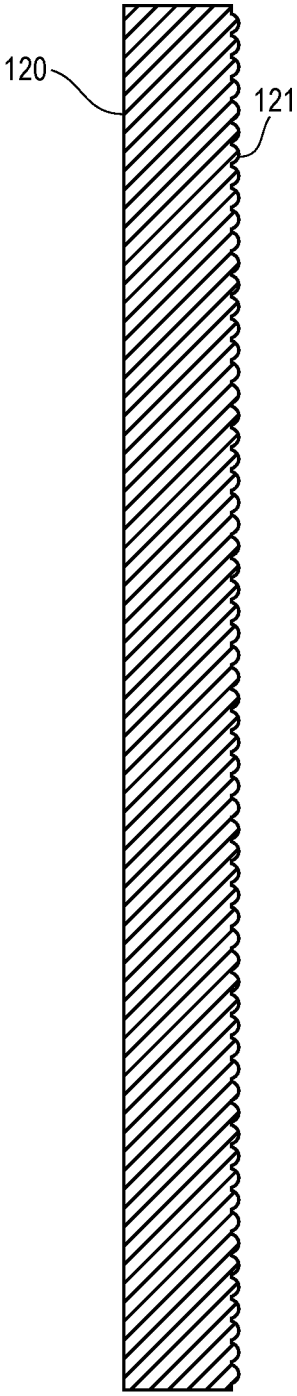
FIG. 12 is a cross sectional view of the garment strap clip shown in FIG. 11 taken along lines 12-12.

According to another embodiment, the rear (or outer) surface 121 of the strap clip, which does not face the wearer's skin, is textured, and the front (or inner) surface 120 of the strap clip is smooth, as shown in FIGS. 11 and 12. The textured rear surface 121 provides an anti-slip functionality which resists sliding up and/or down relative to the garment shoulder straps. The texture can be added to the rear surface during manufacturing, e.g. during 3D printing, of the strap clip. According to another embodiment, the rear (or outer) surface can be knurled or otherwise provided with a high-friction finish to provide the anti-slip functionality. In this embodiment, the front surface 120 which faces the wearer's back is preferably smooth as shown in FIG. 12.

Figure 9:
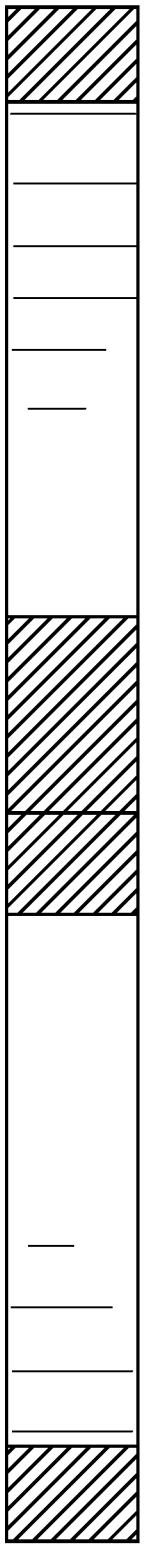
FIG. 9 is a cross sectional view of the engaged garment strap clip shown in FIG. 7 along lines 9-9.

According to one embodiment, the strap clip is about 1 cm to about 6 cm in length, preferably about 3 cm to about 4 cm in length, and most preferably about 6 cm to about 4 cm in length. The strap clip is about 1 cm to about 4 cm in width, preferably about 1.5 cm to about 2 cm in width, and most preferably about 2 cm to about 4 cm in width. According to one embodiment, the strap clip is about 1 mm to about 4 mm thick, preferably about 2 to about 3 mm thick, and most preferably about 3 mm to about 4 mm in width. As shown in FIGS. 9 and 10, which are cross sections of the strap clip 10 along lines 9-9 and lines 10-10 respectively, the thickness of the strap clip 10 is preferably consistent throughout the entire strap clip 10. The below table sets forth dimensions for three sized versions of the disclosed strap clip. Version 2 indicates the presently most preferred dimensions.

| | Version 1 | Version 2 | Version 3 |
|---|---|---|---|
| Length | 4-6 cm | 3-4 cm | 1-3 cm |
| Width | 2-4 cm | 1.5-2 cm | 1-1.5 cm |
| Thickness | 3-4 mm | 2-3 mm | 1-2 mm |

The integrally formed strap clip can be formed using heat-forming manufacturing techniques such as molding or by other known fabrication techniques such as 3D printing, stamping or cutting. In one preferred embodiment, the strap clip is 3D printed. The strap clip can be formed of various polymers or resins, and is preferably formed of recycled polyethylene terephthalate glycol, commonly known as PETG. The use of PETG is preferable due to its durability, its good formability for manufacturing and its cost-effectiveness. For example, the strap clip can alternatively be formed of beer filaments, recycled beer filaments, polypropylene or polyethylene.

Figure 3:
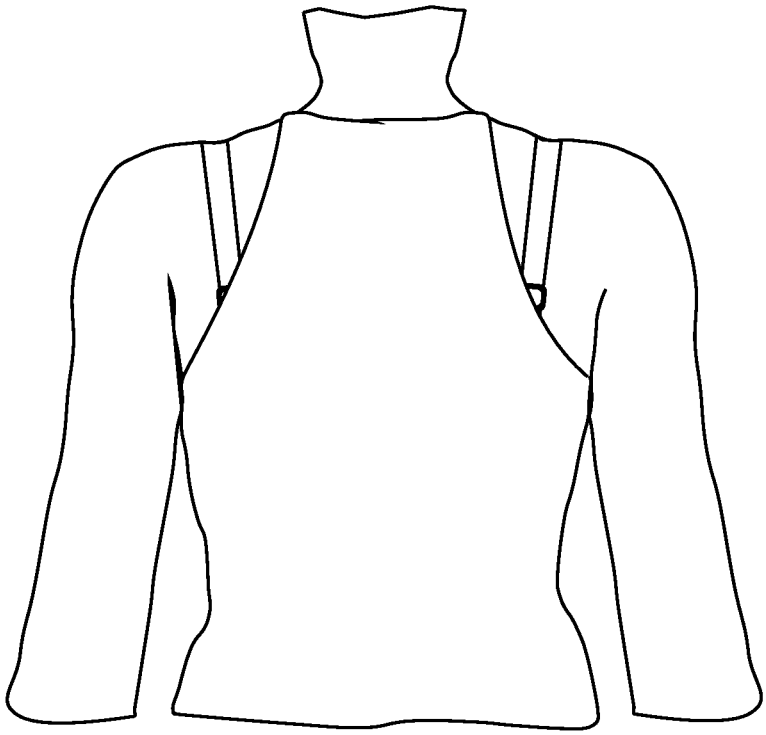
FIG. 3 is a rear view of the upper torso of a woman wearing a halter top and the conventional brassiere shown in FIG. 1.
Figure 4:
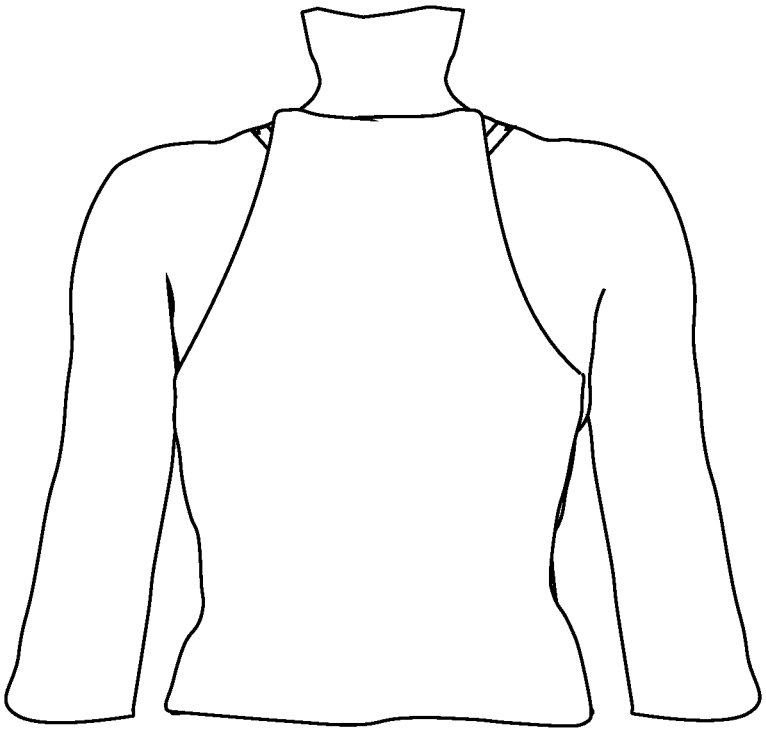
FIG. 4 is a rear view of the upper torso of a woman wearing a halter top and a conventional brassiere with an embodiment of the disclosed garment strap clip attached to the shoulder straps of the brassiere as shown in FIG. 2.
Figure 5:
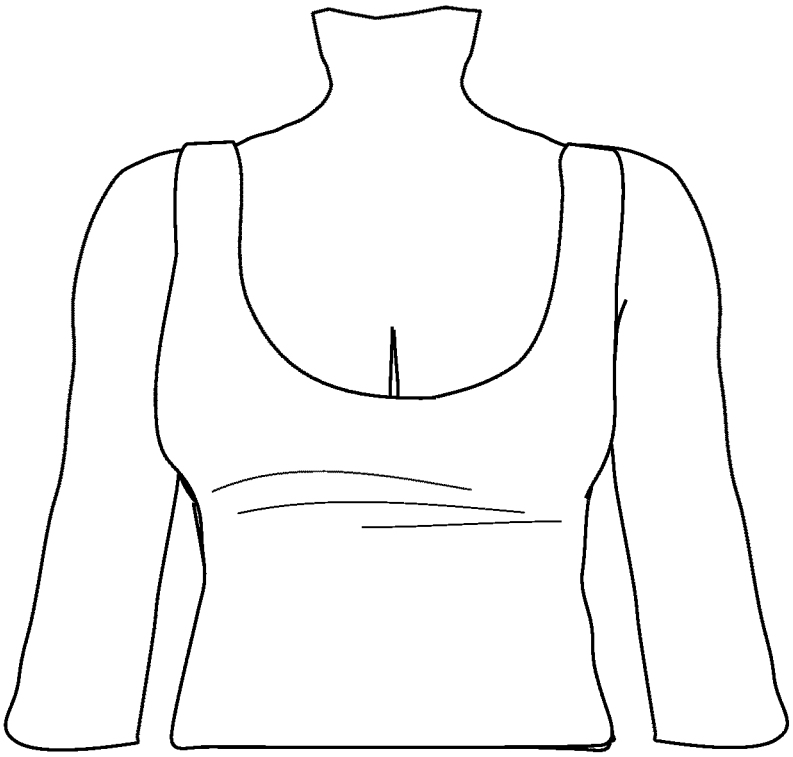
FIG. 5 is a front view of the upper torso of a woman wearing a tank top and the conventional brassiere shown in FIG. 1.
Figure 6:
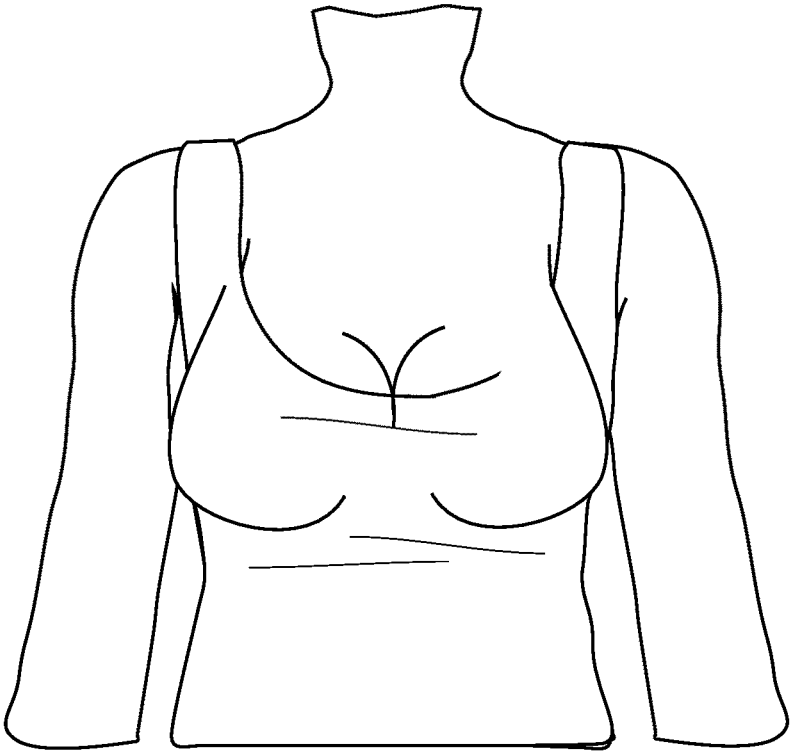
FIG. 6 is a front view of the upper torso of a woman wearing a tank top and a conventional brassiere with the embodiment of the disclosed garment strap clip attached to the shoulder straps of the brassiere shown in FIG. 2.

The disclosed strap clip is intended to be used with any garment, such as bras, and bathing suit tops, having straps running up and over the shoulder of a wearer. The strap clip is attached to minimize the visibility of shoulder straps while wearing certain overgarments such as halter tops and from slipping down the wearer's shoulders. FIG. 3 illustrates a user wearing a halter top with a conventional brassiere shown in FIG. 1, wherein the brassiere straps are highly visible and considered unsightly. FIG. 4 illustrates a user wearing a halter top with a conventional brassiere with the disclosed strap clip attached to the shoulder straps as shown in FIG. 2. As can be seen in FIG. 4, when the strap clip is attached, the brassiere straps are noticeably less visible and are prevented from slipping down the user's shoulders. A further benefit of the use of the disclosed strap clip with a conventional brassiere is also providing further generally vertical support to the breast cups. FIG. 5 illustrates a woman wearing a tank top with a brassiere without the use of the disclosed strap clip. Once the strap clip 10 is attached to the brassiere shoulder straps, the parallel gap of the straps narrows thereby increasing tension on the straps and providing further uplifting support to a wearer's breasts. FIG. 6 illustrates a woman wearing a tank top with a brassiere wherein the disclosed strap clip is attached to the shoulder straps. When the strap clip is attached to the shoulder straps, the user can manually adjust the positioning of the strap clip on the shoulder straps, thereby changing strap configurations. As shown in FIG. 13, an embodiment of the disclosed strap clip 10 can be positioned on the brassiere shoulder straps above the strap sliders of the brassiere. The strap clip 10 can alternatively be positioned below the strap sliders depending on the user's preference, fit and comfort.

Figure 1:
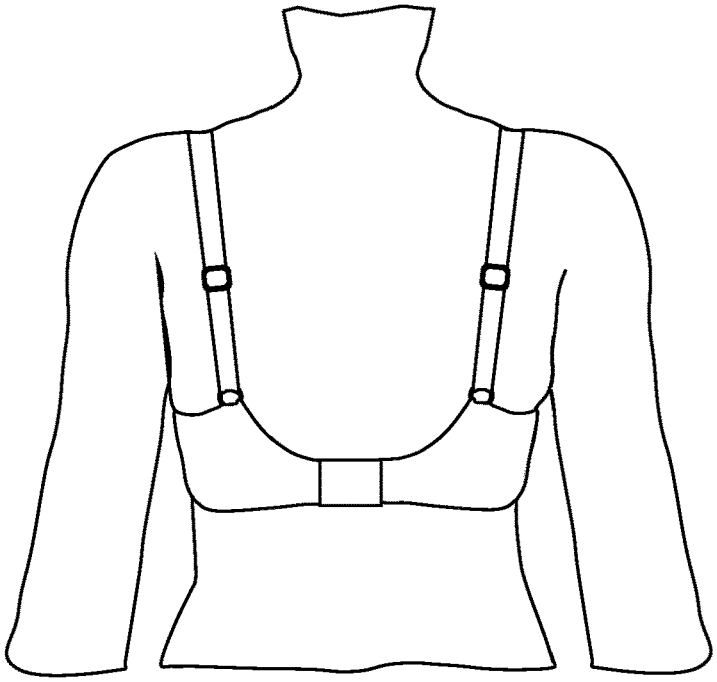
FIG. 1 is a rear view of the upper torso of a woman wearing a conventional brassiere having shoulder straps.

The configuration of the outer portion of the disclosed strap clip is not limited to the shape shown in FIG. 1 and can be any closed curve. More specifically, the configuration of the outer portion of the strap clip can alternatively be generally circular, rectangular, flower-shaped or butterfly-shaped. When used with brassiere undergarments, it is sometimes preferable that the strap clip be as concealed as possible and not obtrusive to others. However, some users may wish to display the strap clip as a decorative accessory to. The disclosed garment clip can be also be used with swim suits having shoulder straps wherein the wearer attaches the garment clip to provide further support and provides a decorative accessory for the swim suit.

Figure 18:
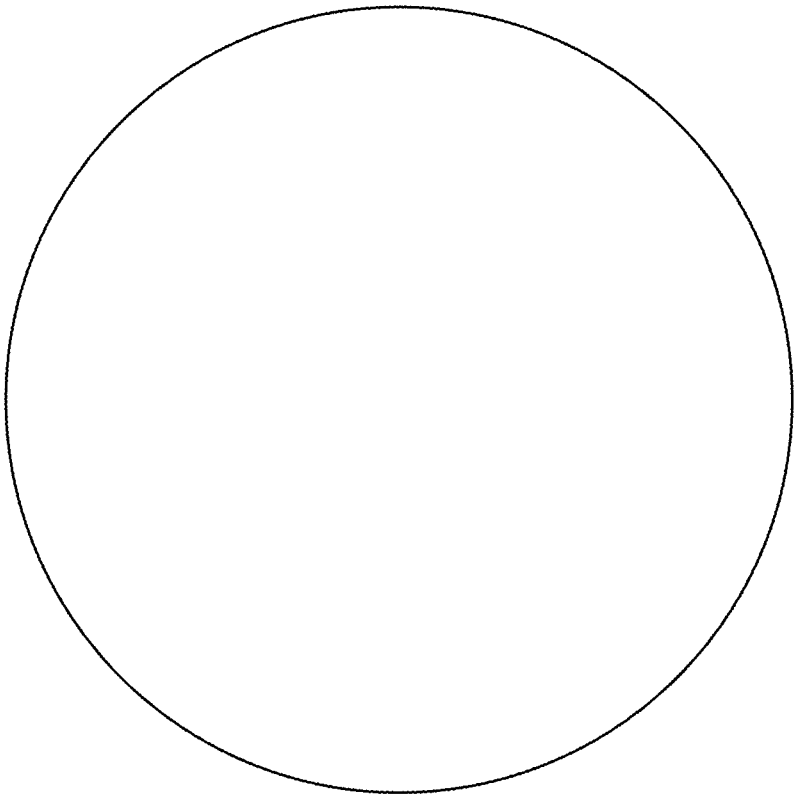
FIG. 18 illustrates the outer portion of a fourth embodiment of a garment strap clip.
Figure 19:
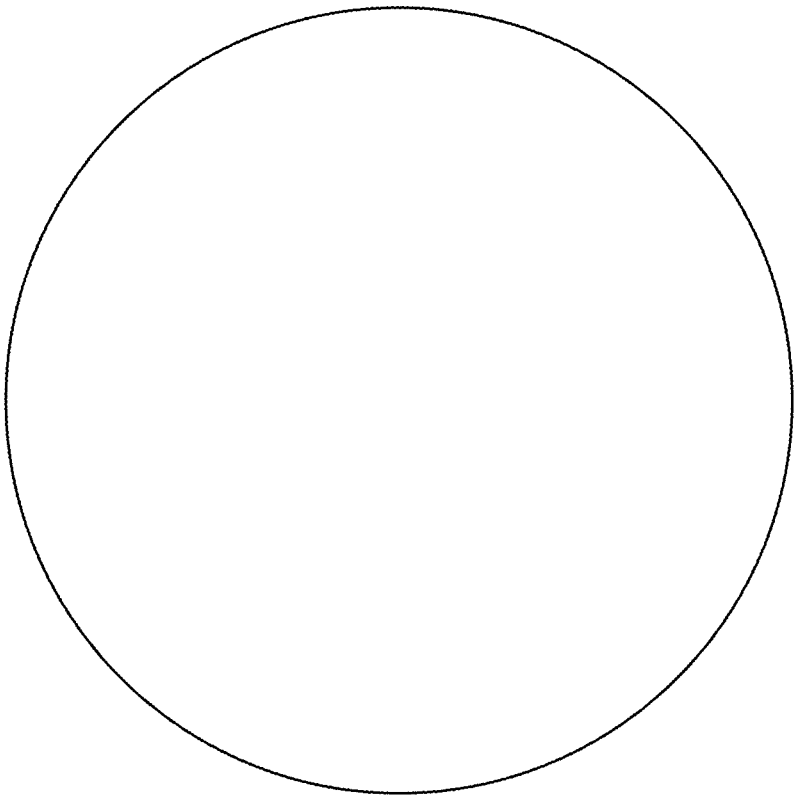

According to a fourth embodiment of the disclosed strap clip, the configuration of the outer portion of the strap clip is generally circular in shape as illustrated in FIG. 18.

The invention claimed is:

1. A garment strap clip comprising:

an outer portion defining a closed curve and comprising a right side and a left side;

a first clip arm comprising a distal portion and a proximal portion, said proximal portion of said first clip arm integrally formed with said right side of said outer portion, said first clip arm extending inwardly from said right side;

a second clip arm comprising a distal portion and a proximal portion, said proximal portion of said second clip arm integrally formed with said left side of said outer portion, said second clip arm extending inwardly from said left side;

said distal portion of said first clip arm comprising a right hook portion and said distal portion of said second clip arm comprising a left hook portion;

wherein said first clip arm and said second clip arm are selectively positionable in a disengaged configuration or in an engaged configuration, and wherein when said right clip arm and said left clip arm are in said disengaged configuration said right hook portion is in contact with said left hook portion in the absence of external forces applied manually by a person.

2. The garment strap clip according to claim 1 wherein said right hook portion and said left hook portion are selectively separable.

3. The garment strap clip according to claim 1 wherein said right hook portion comprises an inner surface and said left hook portion comprises an inner surface and wherein when said first clip arm and said second clip arm are in said engaged configuration, said respective inner surfaces of said right hook portion and said left hook portion are in contact.

4. The garment strap clip according to claim 3 wherein said inner surface of said right hook portion and said inner surface of said left hook portion are configured to be urged in opposing directions when in said engaged configuration.

5. The garment strap clip according to claim 3 wherein said outer portion is resilient so that when said right side of said outer portion and said left side of said outer portion are moved toward each other, said first clip arm and said second clip arm are positionable in said engaged configuration and said right hook inner surface and said left hook inner surface are configured to be urged into contact by opposing forces applied by said right side of said outer portion and said left side of said outer portion.

6. The garment strap clip according to claim 1 wherein said first clip arm further comprises an intermediate portion between said distal portion and said proximal portion, said first clip intermediate portion extends diagonally inwardly from said right clip arm proximal portion, and said second clip arm further comprises an intermediate portion between said distal portion and said proximal portion, said second clip arm intermediate portion extends diagonally inwardly from said left clip arm proximal portion and wherein said intermediate portion of said first clip arm is generally parallel to and opposing to said intermediate portion of said second clip arm.

7. The garment strap clip according to claim 1 wherein said outer portion is generally figure-8 shaped.

8. The garment strap clip according to claim 1 wherein said outer portion is generally circular shaped.

9. A garment strap clip according to claim 1 further comprising a rear surface and a front surface, wherein said rear surface and said front surface are smooth.

10. The garment strap clip according to claim 1 further comprising a rear surface and a front surface, wherein at least one of said front surface and said rear surface is textured.

11. The garment strap clip according to claim 1, wherein said clip is 1 cm to 6 cm in length, 1 cm to 4 cm in width, and 1 mm to 4 mm thick.

12. The garment strap clip according to claim 1, wherein said clip is 3 cm to 4 cm in length, 1.5 cm to 2 cm in width, and 2 mm to 3 mm thick.

13. The garment strap clip according to claim 1, wherein said clip is 4 cm to 6 cm in length, 2 cm to 4 cm in width, and 3 mm to 4 mm thick.

14. The garment strap clip according to claim 13 further comprising polyethylene terephthalate glycol.

15. The garment strap clip according to claim 1 comprising at least one of a polymer or resin.

16. The garment strap clip according to claim 1 wherein said outer portion comprises rounded edges.

17. A woman's garment comprising:

at least two shoulder straps; and a garment strap clip comprising:

an outer portion defining a closed curve and comprising a right side and a left side;

a first clip arm comprising a distal portion and a proximal portion, said proximal portion of said first clip arm integrally formed with said right side of said outer portion, said first clip arm extending inwardly from said right side;

a second clip arm comprising a distal portion and a proximal portion, said proximal portion of said second clip arm integrally formed with said left side of said outer portion, said second clip arm extending inwardly from said left side;

said distal portion of said first clip arm comprising a right hook portion and said distal portion of said second clip arm comprising a left hook portion;

wherein said first clip arm and said second clip arm are selectively positionable in a disengaged configuration or in an engaged configuration and wherein said at least two shoulder straps engage with said first clip arm and said second clip arm; and wherein when said right clip arm and said left clip arm are in said disengaged configuration said right hook portion is in contact with said left hook portion in the absence of external forces applied manually by a person.

* * * * *